US010503114B2

(12) United States Patent
Nagashima et al.

(10) Patent No.: US 10,503,114 B2
(45) Date of Patent: Dec. 10, 2019

(54) IMAGE FORMING APPARATUS

(71) Applicant: KYOCERA Document Solutions Inc., Osaka (JP)

(72) Inventors: Teruhiko Nagashima, Osaka (JP); Hidenori Takenaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/254,409

(22) Filed: Jan. 22, 2019

(65) Prior Publication Data

US 2019/0265631 A1 Aug. 29, 2019

(30) Foreign Application Priority Data

Feb. 28, 2018 (JP) ..... 2018-034891

(51) Int. Cl.
*G03G 15/00* (2006.01)
*G03G 15/04* (2006.01)

(52) U.S. Cl.
CPC ..... *G03G 15/751* (2013.01); *G03G 15/04072* (2013.01); *G03G 2221/1606* (2013.01)

(58) Field of Classification Search
None
See application file for complete search history.

(56) References Cited

U.S. PATENT DOCUMENTS 4,816,844 A * 3/1989 Uchida ..... G06K 15/1295 346/145
5,072,244 A * 12/1991 Aoki ..... H04N 1/047 347/116
5,442,388 A * 8/1995 Schieck ..... B41F 13/12 347/116
8,073,378 B2 * 12/2011 Calamita ..... G03G 15/75 347/116
2003/0133166 A1 * 7/2003 Yamanaka ..... G02B 7/1824 358/300
2004/0253013 A1 * 12/2004 Furukawa ..... G03G 15/0194 399/49
2006/0082795 A1 * 4/2006 Seo ..... G03G 15/04045 358/1.5

FOREIGN PATENT DOCUMENTS

JP H08-146317 A 6/1996
JP 09068673 A * 3/1997
JP 2000-098685 A 4/2000

* cited by examiner

*Primary Examiner* — Sevan A Aydin
(74) *Attorney, Agent, or Firm* — Studebaker & Brackett PC

(57) ABSTRACT

An image forming apparatus includes a photosensitive drum, an exposure device, a supporting member and a main adjustment member. The photosensitive drum is provided for each of colors forming a color image. The exposure device is configured to emit a laser light on each of the photosensitive drums to form an electrostatic latent image. The supporting member is configured to support end portions of rotation shafts of all the photosensitive drums. The main adjustment member is configured to shift the supporting member in a vertical plane to adjust a skew of the laser light.

10 Claims, 15 Drawing Sheets

IMAGE FORMING APPARATUS

INCORPORATION BY REFERENCE

This application is based on and claims the benefit of priority from Japanese Patent application No. 2018-034891 filed on Feb. 28, 2018, which is incorporated by reference in its entirety.

BACKGROUND

The present disclosure relates to an image forming apparatus provided with a photosensitive drum on which an electrostatic latent image is formed.

In an electrophotographic type image forming apparatus, a photosensitive drum is exposed with laser light emitted from an optical element of an exposure device to form an electrostatic latent image on the photosensitive drum. If the exposure device is slightly displaced from the photosensitive drum, a skew (a distortion) occurs on the image (the electrostatic latent image) on the photosensitive drum. This causes a color shift. Because plural elements are conventionally arranged between the optical element and the photosensitive drum, it is difficult to position the optical element and the photosensitive drum with a high precision.

For example, the image forming apparatus is sometimes provided with an exposure device arranged obliquely with respect to a rotation shaft of the photosensitive drum. In the image forming apparatus, a rotation speed of the photosensitive drum is finely adjusted such that an inclination of the toner image is the same as the inclination of the exposure device. Alternatively, another image forming apparatus is provided with an exposure device in which a mirror is finely adjusted by using a stepping motor.

However, in a case where the optical element of the exposure device is finely adjusted, the structure and the control process of the exposure device may be complicated and the exposure device may be made large in size.

SUMMARY

In accordance with an aspect of the present disclosure, an image forming apparatus includes a photosensitive drum, an exposure device, a supporting member and a main adjustment member. The photosensitive drum is provided for each of a plurality of colors forming a color image. The exposure device is configured to emit a laser light on each of the photosensitive drums to form an electrostatic latent image. The supporting member is configured to support end portions of rotation shafts of all the photosensitive drums. The main adjustment member is configured to shift the supporting member in a vertical plane to adjust a skew of the laser light.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus according to one embodiment of the present disclosure will be described.

Figure 1:
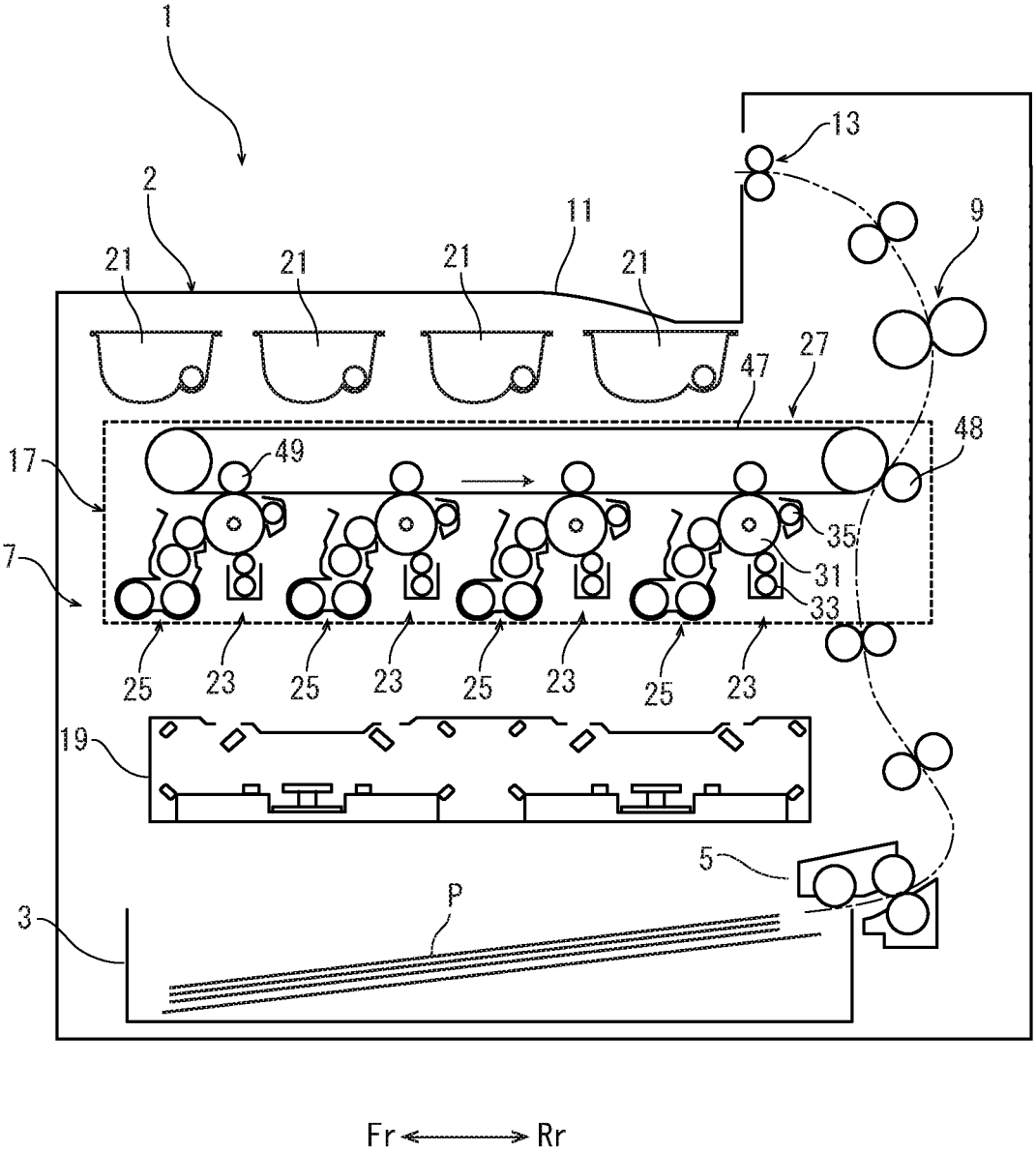
FIG. 1 is a sectional view schematically showing an inner structure of a color printer according to one embodiment of the present disclosure.

First, with reference to FIG. 1, an entire structure of a color printer 1 as the image forming apparatus will be described. FIG. 1 is a front view schematically showing an inner structure of the color printer. In the following description, a left side of FIG. 1 is defined to be a front side of the color printer 1. In each figure, Fr, Rr, L, R, U and Lo respectively indicate a front side, a rear side, a left side, a right side, an upper side and a lower side of the color printer 1.

An apparatus main body 2 of the color printer 1 includes a sheet feeding cassette 3 storing a sheet P, a sheet feeding device 5 feeding the sheet P from the sheet feeding cassette 3, an image forming part 7 forming a full color toner image on the sheet P, a fixing device 9 fixing the toner image on the sheet P, and a sheet ejecting device 13 ejecting the sheet P, having a fixed toner image, on an ejected sheet tray 11. In the apparatus main body 2, a conveying path for the sheet P is formed from the sheet feeding device 5 to the sheet ejecting device 13 through the image forming part 7 and the fixing device 9.

The image forming part 7 is provided with an image forming unit 17, an exposure device 19 arranged below the image forming unit 17 and four toner containers 21 arranged above the image forming unit 17.

Figure 2:
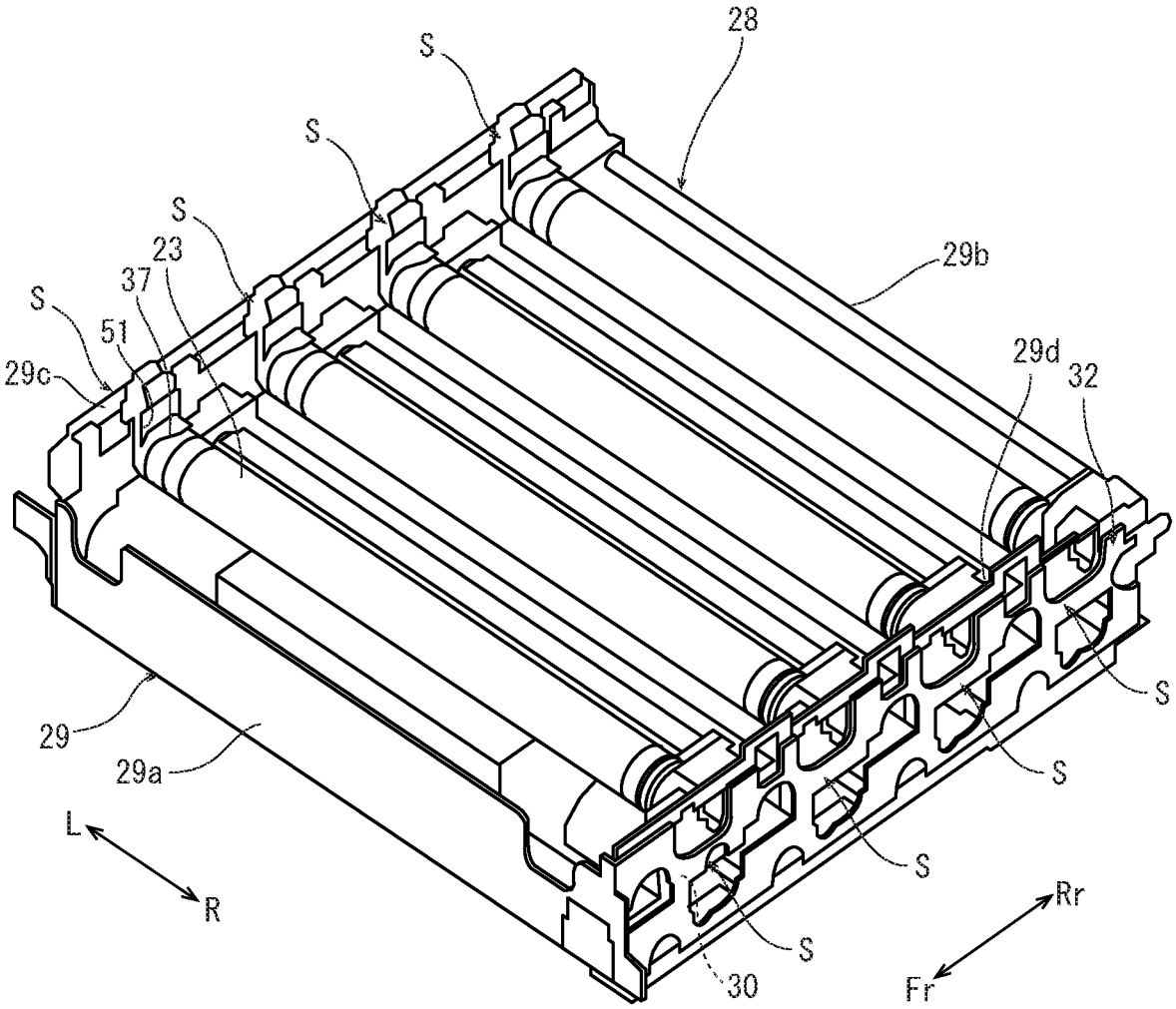
FIG. 2 is a perspective view showing an image forming frame to which a drum unit is attached, in the color printer according to the embodiment of the present disclosure.

Next, with reference to FIG. 1 and FIG. 2, the image forming unit 17 will be described. FIG. 2 is a perspective view showing an image forming frame to which a drum unit and a development unit are attached.

The image forming unit 17 includes four drum units 23, four development units 25, an intermediate transferring unit 27 and an image forming frame 28 (refer to FIG. 2) to which the drum units 23 and the development units 25 are supported. The four drum units 23 and the four development units 25 correspond to four colors (yellow, magenta, cyan and black) of toners (developers).

Figure 3:
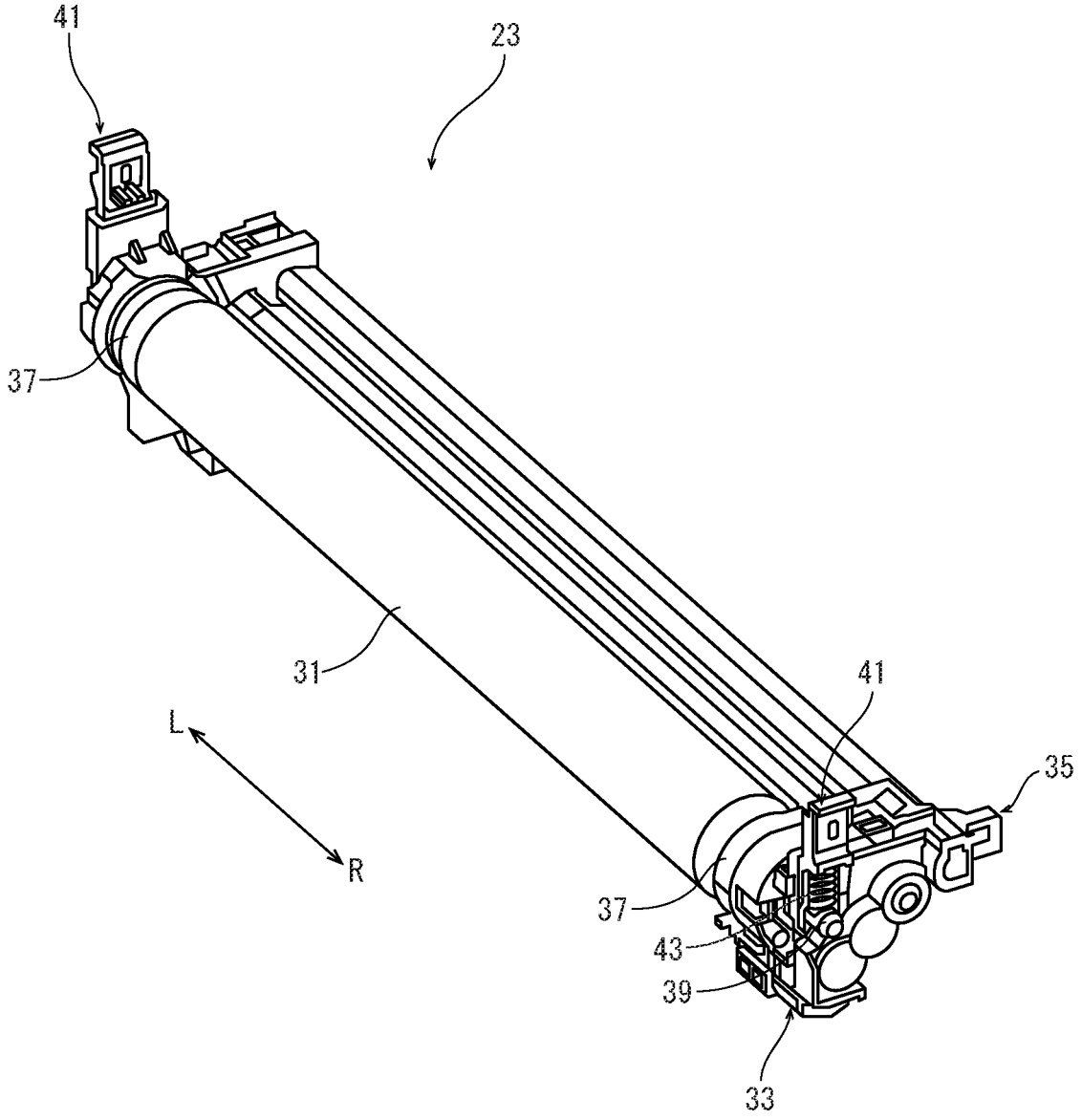
FIG. 3 is a perspective view showing the drum unit, in the color printer according to the embodiment of the present disclosure.

Next, with reference to FIG. 3, the drum unit 23 will be described. FIG. 3 is a perspective view showing the drum unit 23.

The drum unit 23 includes a photosensitive drum 31 on which an electrostatic latent image is formed. To both end openings of the photosensitive drum 31, flange members 37 are fixed. Between the flange members 37, a rotation shaft 39 is penetrated along an axial center of the photosensitive drum 31, and the photosensitive drum 31 is rotated around the rotation shaft 39. The left flange member 37 and a right end portion of the rotation shaft 39 are each inserted in a pressing lever 41. Between the left pressing lever 41 and the left flange member 37 and between the right pressing lever 41 and the right end portion of the rotation shaft 39, respective springs 43 are interposed. The spring 43 is a biasing member which biases each of the left flange member 37 and the right end portion of the rotation shaft 39 downward.

The drum unit 23 further includes a charge device 33 charging the photosensitive drum 31 and a cleaning device removing the toner remaining on the surface of the photosensitive drum 31. The charge device 33 and the cleaning device 35 are arranged along the rotation direction (the clockwise direction in FIG. 1) of the photosensitive drum 31 around an outer circumferential face of the photosensitive drum 31.

With reference to FIG. 1 again, the development unit includes a development device which develops the electrostatic latent image formed on the surface of the photosensitive drum 31 into a toner image with the toner. The development unit 25 is arranged between the charge device 33 and the cleaning device 35 in the rotation direction of the photosensitive drum 31.

The intermediate transferring unit 27 includes an endless intermediate transferring belt 47 and four primary transferring rollers 49 disposed in a hollow space of the intermediate transferring belt 47. Each primary transferring roller 49 is arranged between the development unit 25 and the cleaning device 35 of the drum unit 23 along the rotation direction of the photosensitive drum 31, and faces the photosensitive drum 31 via the intermediate transferring belt 47. The apparatus main body 2 is provided with a secondary transferring roller 48 disposed at a rear side of the intermediate transferring unit 27 so as to face the intermediate transferring belt 47.

The four toner containers 21 store the respective toners of the four colors (yellow, magenta, cyan and black). The toners are supplied from the four toner containers 21 to the respective development units 25.

The exposure device 19 emits laser light toward the photosensitive drum 31 of each drum unit 23. An angle of incidence of the laser light with respect to a tangential direction T on the surface of the photosensitive drum 31 is zero, as described later with reference to FIG. 13. An irradiation angle of the laser light with respect to a vertical line passing through the axial center of the photosensitive drum 31 is about 10 degrees.

Next, an image forming operation will be described. In the image forming part 7, the photosensitive drum 31 of each drum unit 23 is charged by the charge device 33 and then exposed by the exposure device 19 according to an image date to form the electrostatic latent image on the photosensitive drum 31. The electrostatic latent image is developed to the toner image by the development device of each development unit 25. Each toner image is transferred from the photosensitive drum 31 to the intermediate transferring belt 47 by the primary transferring roller 49 of the intermediate transferring unit 27. Thereby, a full color toner image is formed on the intermediate transferring belt 47. The full color toner image is transferred from the intermediate transferring belt 47 to the sheet P by the secondary transferring roller 48. The toner remaining on the photosensitive drum 31 is removed by the cleaning device 35 of the drum unit 23. The sheet P on which the full color toner image is transferred is conveyed to the fixing device 9. The fixing device 9 fixes the full color toner image on the sheet P. The sheet P on which the full color toner image is fixed is ejected to the ejected sheet tray 11 by the sheet ejecting device 13.

Figure 4:
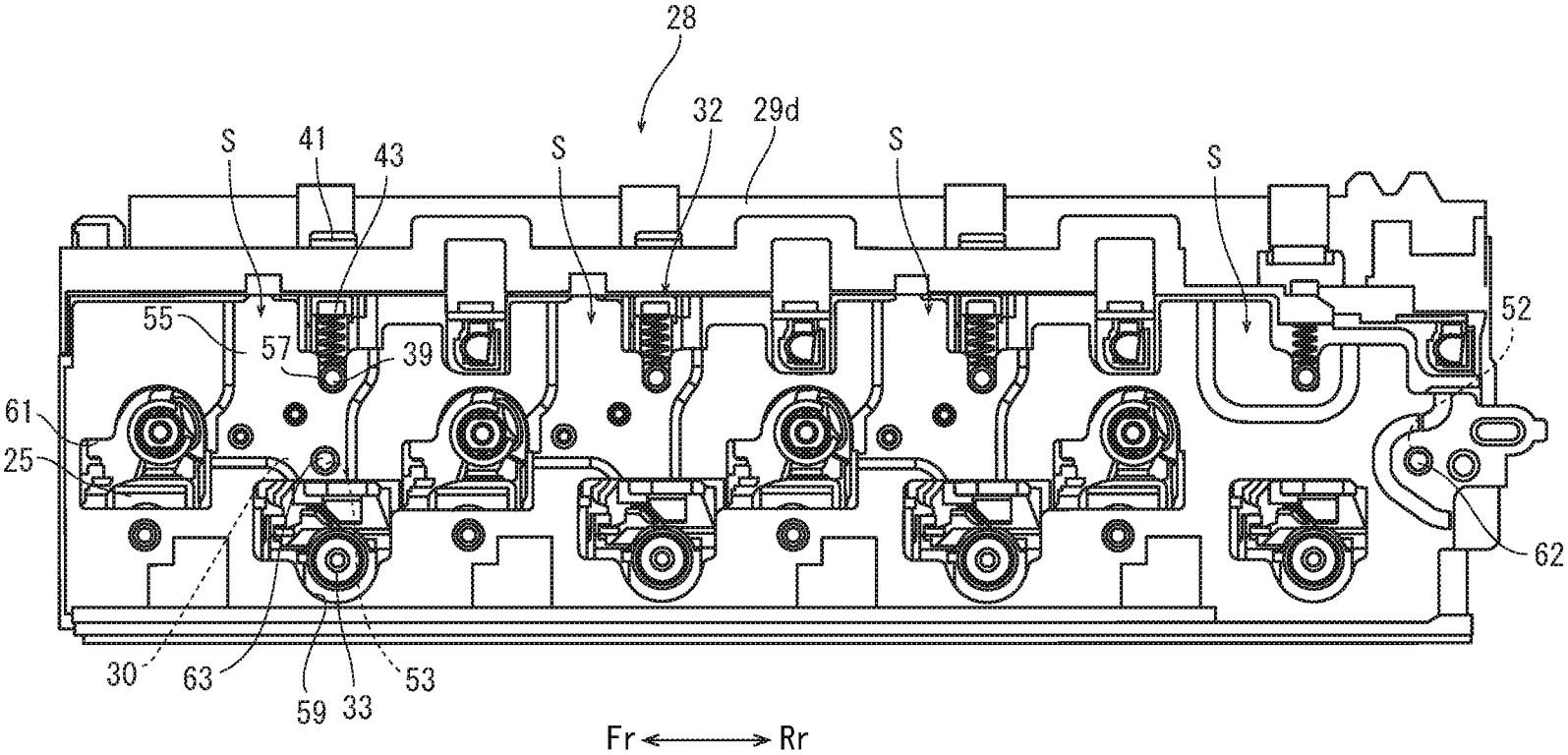
FIG. 4 is a front view showing an outer side plate and a right side plate in a skew adjustment way of a first embodiment, in the color printer according to the embodiment of the present disclosure.

Next, the image forming frame 28 will be described with reference to FIG. 2 and FIG. 4. FIG. 4 is a front view showing aright sideplate and an outer side plate. The image forming frame 28 includes a rectangular cylindrical main frame 29, an outer side plate 32 as a supporting member and a main adjustment mechanism 30 which shifts the outer side plate 32 in a vertical plane.

The main frame 29 includes a front side plate 29*a* and a rear side plate 29*b* which face each other in the front-and-rear direction and a left sideplate 29*c* and a right side plate 29*d* which face each other in the left-and-right direction. Between the left sideplate 29*c* and the right side plate 29*d*, four attachment sections S to which the four drum units 23 and the four development units 25 are attached are formed in parallel along the front-and-rear direction (a parallel direction). The four attachment sections S correspond to yellow, magenta, cyan and black in the order from the front side to the rear side of the main frame 29. In the present embodiment, the black color is defined as a reference color.

In each attachment section S of the left side plate 29*c*, a flange receiving groove 51 is formed. The flange receiving groove 51 is cut out from an upper edge of the left side plate 29*c* downward. Into the flange receiving groove 51, the left flange member 37 of the photosensitive drum 31 of each drum unit 23 is inserted.

The right side plate 29*d* has an axis hole 52 and a groove 53 as shown in FIG. 4. The axis hole 52 is formed in a rear end portion of the right side plate 29*d*, and the groove 53 is formed in a front end portion of the right side plate 29*d*. The groove 53 is formed along a circumferential direction of a circle around the axis hole 52.

The outer side plate 32 will be described with reference to FIG. 4. The outer side plate 32 has substantially the same shape as the right sideplate 29*d*. The outer side plate 32 has a supporting shaft 62 and a movable shaft 63. The supporting shaft 62 is protruded on a rear end portion of an inner face (a face facing the right side plate 29*d*) of the outer side plate 32. The movable shaft 63 is protruded on a front end portion of the inner face of the outer side plate 32. The supporting shaft 62 is inserted into the axis hole 52 of the right side plate 29*d*. The movable shaft 63 is inserted into the groove 53 of the right side plate 29*d*.

The outer side plate 32 is formed with four attachment sections S to which the respective drum units 23 and the respective development units 25 are attached. The four attachment sections S corresponds to the respective attachment sections S of the right side plate 29*d*. In each attachment section S, a hollow portion 55 recessed from an outside to an inside is formed. In the hollow portion 55, a vertical groove 57 is formed. The vertical groove 57 is cut out from an upper edge of the outer sideplate 32 downward. Into the vertical groove 57, the right end portion of the rotation shaft 39 of the photosensitive drum 31 is inserted. In each attachment section S, a lower opening 59 and a side opening 61 are formed at a lower position and an oblique front lower position of the vertical groove 57, respectively. When the drum unit 23 and the development unit 25 are attached to the attachment section S, the charge device 33 of the drum unit 23 and the development device of the development unit 25 are respectively exposed through the lower opening 59 and the side opening 61. Both the openings 59 and 61 are communicated with the hollow portion 55.

Next, the main adjustment mechanism 30 will be described with reference to FIG. 5 and FIG. 6. FIG. 6 is a front view showing the main adjustment mechanism and FIG. 6 is a sectional view showing the main adjustment mechanism. The main adjustment mechanism 30 includes an adjustment plate 65 and a dial gear 67. The adjustment plate 65 is an adjustment member shifting the outer side plate 32 in the vertical plane. The dial gear 67 is a dial rotating the adjustment plate 65.

The main adjustment mechanism 30 is supported by the right side plate 29*d*. On an outer face (a face facing the outer side plate 32) of the right side plate 29*d*, a first shaft 29*g*, a second shaft 29*h* and a protrusion 29*i* are formed. The first shaft 29*g* is protruded rightward at an obliquely lower position of a lower end portion of the groove 53. The second shaft 29*h* is protruded rightward at an obliquely lower position of the first shaft 29*g*. The protrusion 29*i* extends rearward horizontally from the second shaft 29*h*.

Figure 7:
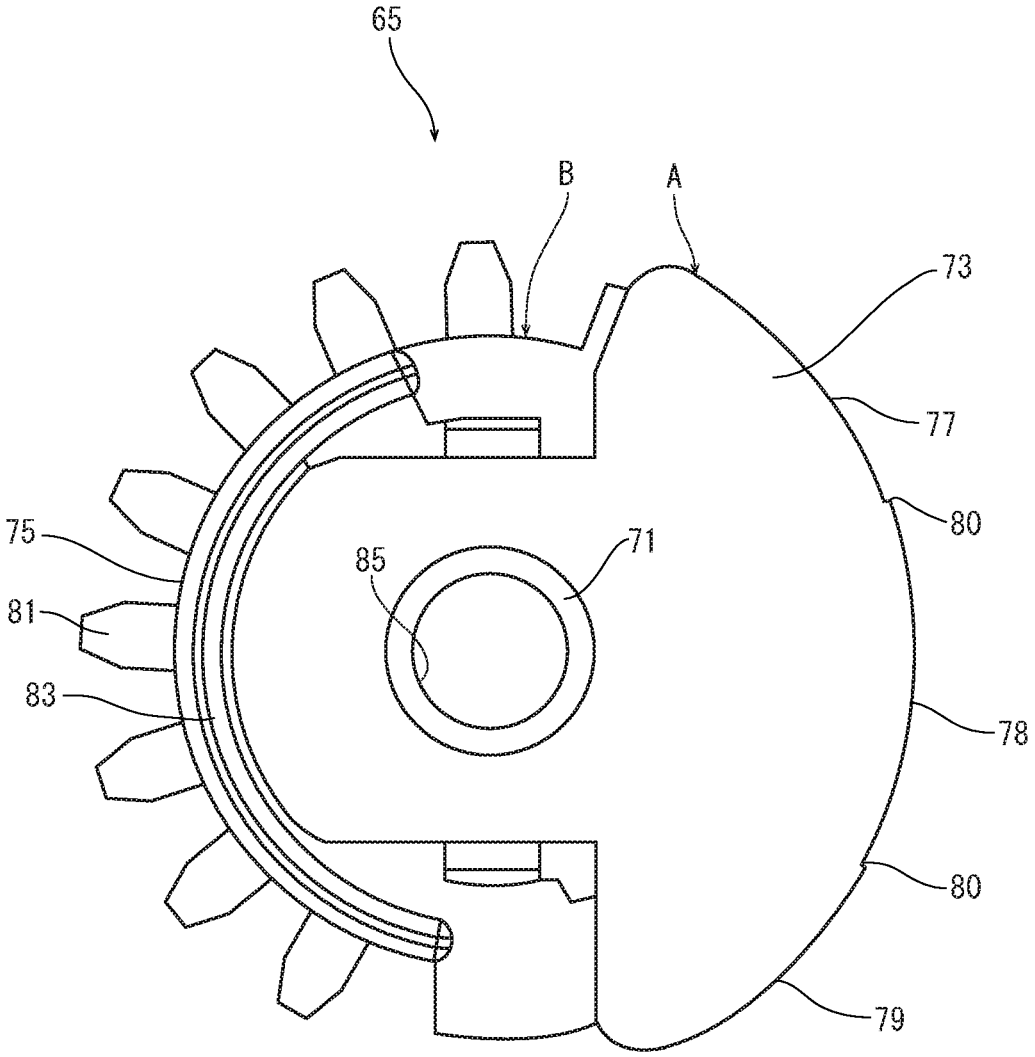
FIG. 7 is a front view showing an adjustment plate, in the color printer according to the embodiment of the present disclosure.

Next, the adjustment plate 65 will be described with reference to FIG. 7. FIG. 7 is a front view showing the adjustment plate.

The adjustment plate 65 is a disk-shaped member, and includes a cylindrical axial hole part 71, an approximately semicircular adjustment part 73 and an approximately semicircular gear part 75. The adjustment part 73 is provided at one side (the rear side) of the axial hole part 71 and the gear part 75 is provided at the other side (the front side) of the axial hole part 71. Around an outer circumferential edge of the adjustment part 73, a first arc-shaped edge 77, a second arc-shaped edge 78 and a third arc-shaped edge 79 are formed in the order in the circumferential direction. The first arc-shaped edge 77, the second arc-shaped edge 78 and the third arc-shaped edge 79 have different radius, and the radius becomes large in a stepwise manner in the order. For example, a difference in the radius between the adjacent arc-shaped edges is 0.1 mm. The adjacent arc-shaped edges are connected via a stepped portion 80 extending radially. Around an outer circumferential edge of the gear part 75, gear teeth 81 are formed at predetermined intervals. On one face of the gear part 75, an arc-shaped rib 83 along the circumferential direction is formed. A tip end face of the rib 83 is formed in a semi-circular cross section.

The adjustment plate 65 is formed by preparing a member A formed with the axial hole part 71 and the adjustment part 73 integrally and a member B formed with the gear part 75 and an axial hole 85 integrally, overlapping them with aligning the axial hole part 71 and the axial hole 85 coaxially and then coupling them, as shown in FIG. 6 and FIG. 7. The member A is made of metal, and the member B is made of resin. However, the configuration of the adjustment plate 65 is not limited thereto.

The adjustment plate 65 is supported by the first shaft 29*g* of the right side plate 29*d* with the rib 83 facing the outer side plate 32. As shown in FIG. 5, a part of the outer circumferential edge of the adjustment part 73 is exposed to a lower end portion of the groove 53 obliquely from the front lower side.

Figure 8:
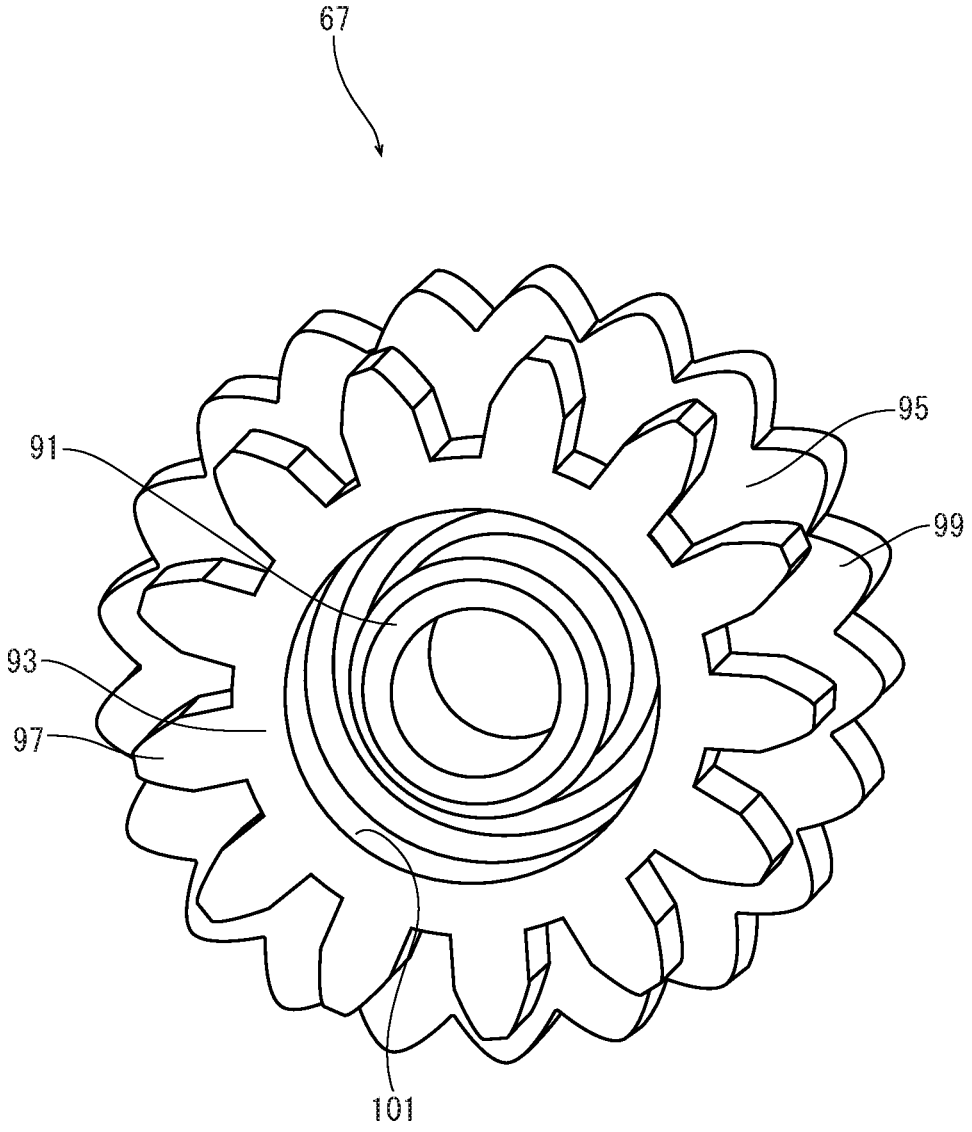
FIG. 8 is a perspective view showing a dial gear, in the color printer according to the embodiment of the present disclosure.
Figure 9A:
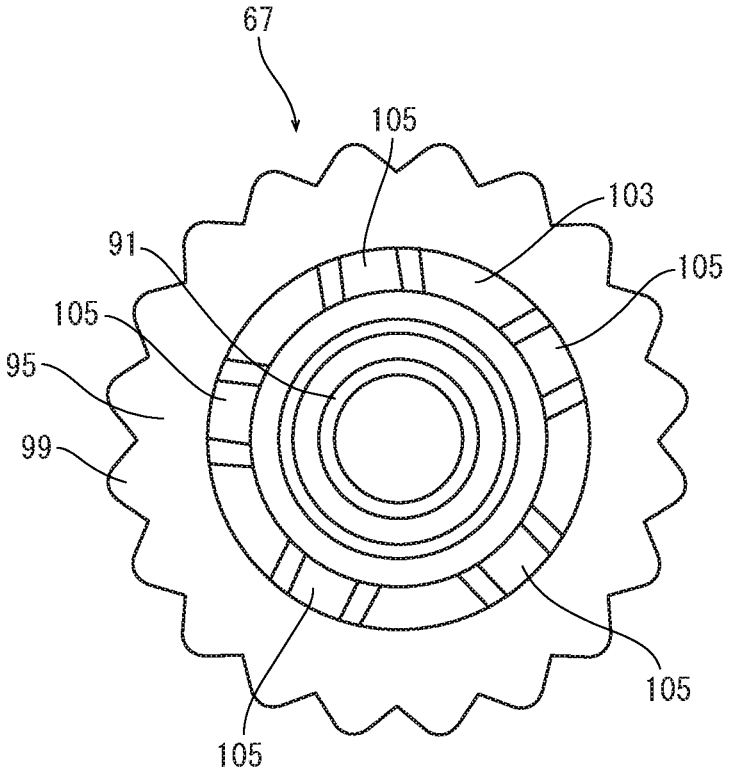
FIG. 9A is a back view showing the dial gear, in the color printer according to the embodiment of the present disclosure.
Figure 9B:
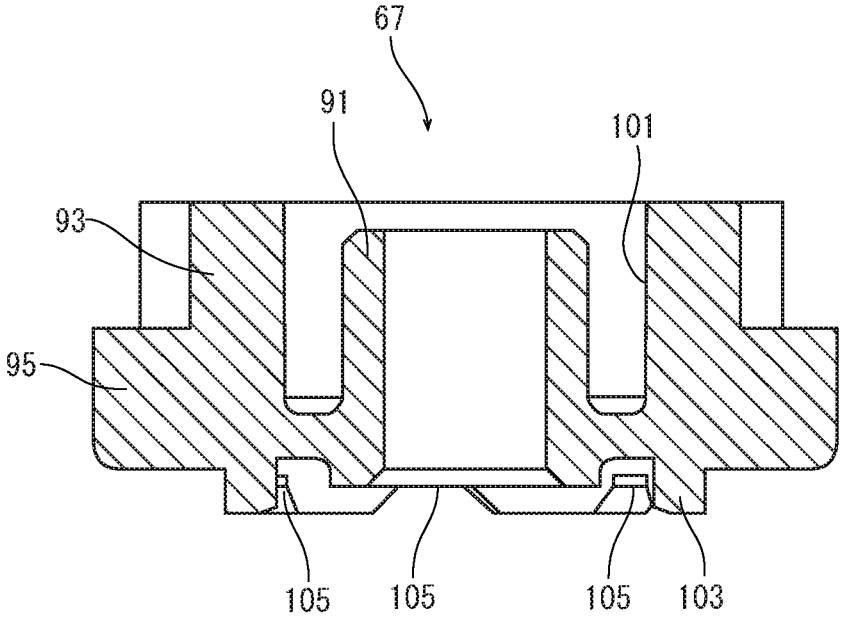
FIG. 9B is a sectional view showing the dial gear, in the color printer according to the embodiment of the present disclosure.

Next, the dial gear 67 will be described with reference to FIG. 8, FIG. 9A and FIG. 9B. FIG. 8 is a perspective view showing the dial gear, FIG. 9A is a back view showing the dial gear and FIG. 9B is a sectional view showing the dial gear.

The dial gear 67 is a disk-shaped member, and includes an axial hole part 91, a gear part 93 and a rack part 95 which are provided coaxially with the axial hole part 91. The rack part 95 has an outer diameter larger than that of the gear part 93. Along an outer circumferential edge of the gear part 93, gear teeth 97 engageable with the gear teeth 81 of the gear part 75 of the adjustment plate 65 are formed. Along an outer circumferential edge of the rack part 95, rack teeth 99 are formed at predetermined intervals.

On one face (a face at the side of the gear part 93) of the dial gear 67, an annular groove 101 is formed around the axial hole part 91. As shown in FIG. 9A and FIG. 9B, on the other face (a face at the side of the rack part 95) of the dial gear 67, an annular rib 103 is formed around the axial hole part 91. The rib 103 has plural (for example, five) recesses 105 arranged along the circumferential direction at equal center angles. Both side faces of each recess 105 are inclined outward in the circumferential direction.

Figure 5:
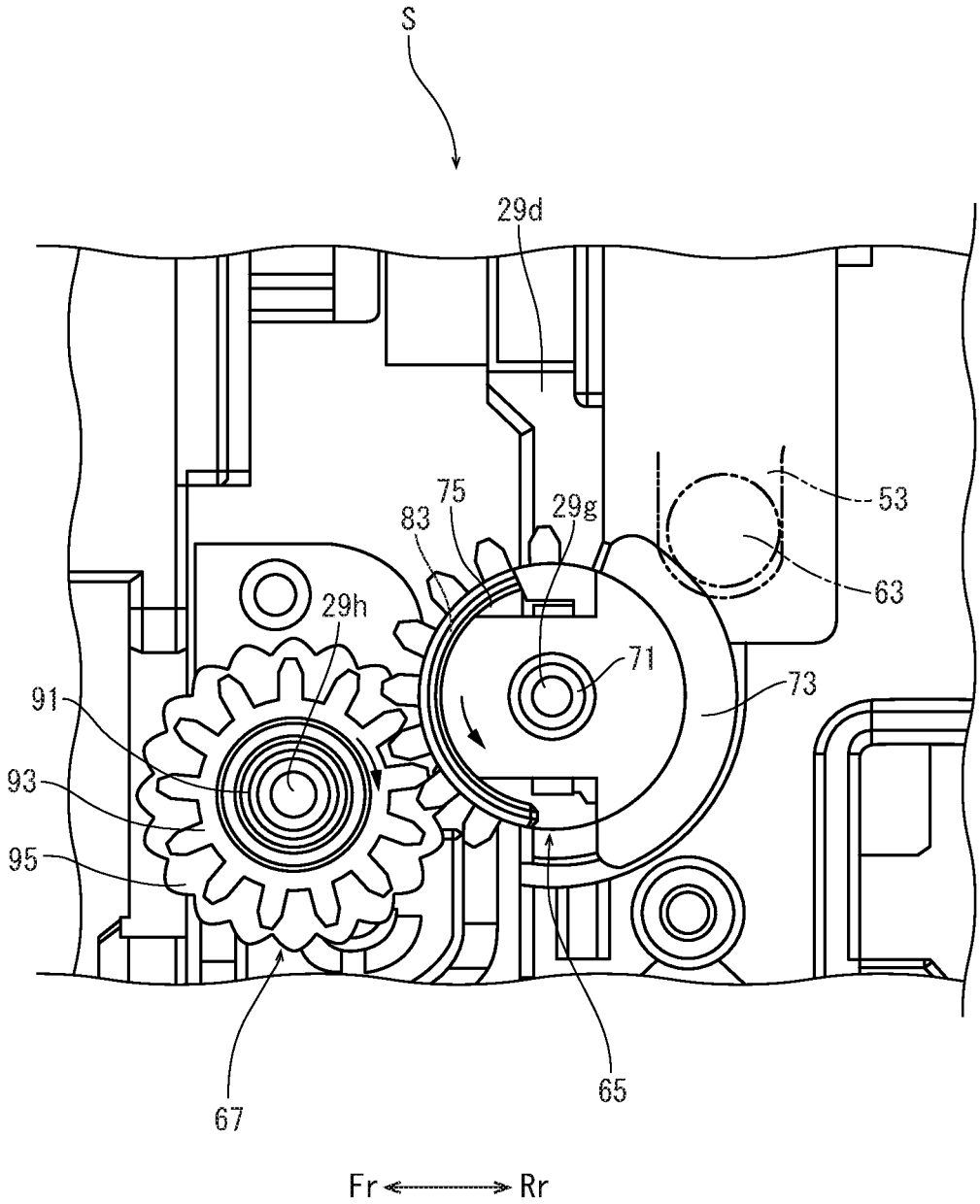
FIG. 5 is a front view showing a main adjustment mechanism, in the color printer according to the embodiment of the present disclosure.
Figure 6:
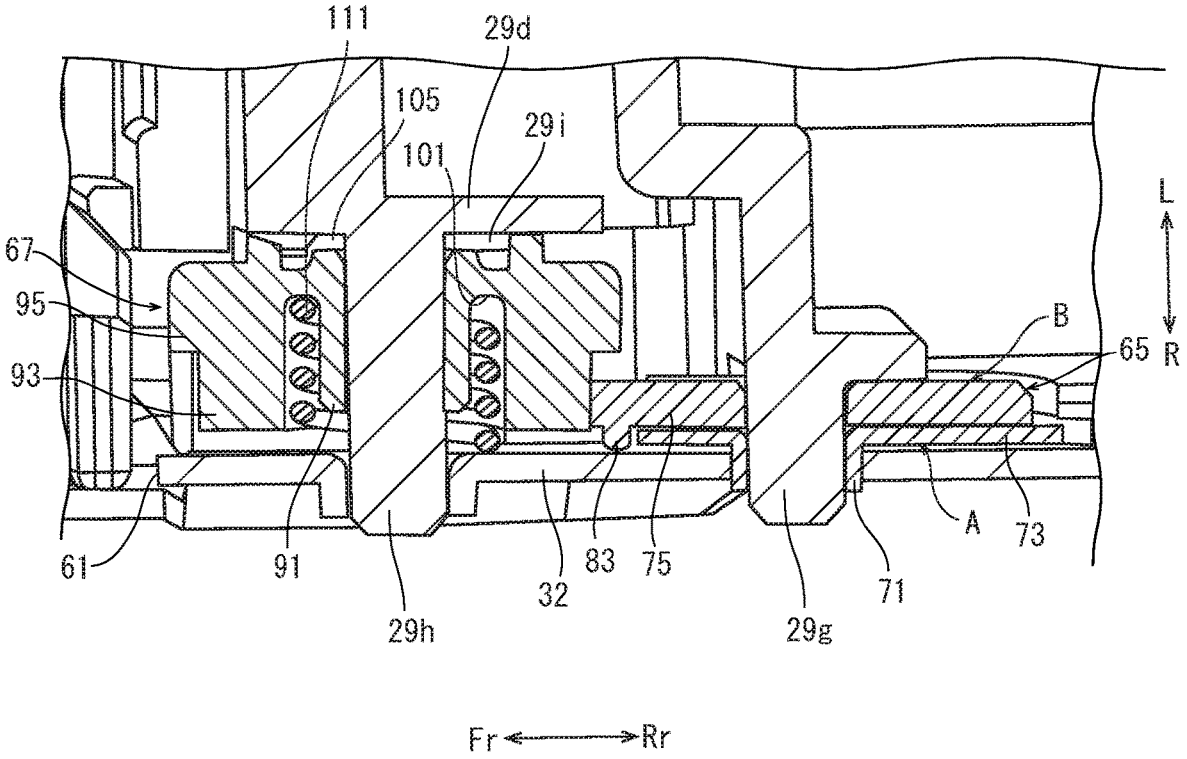
FIG. 6 is a sectional view showing the main adjustment mechanism, in the color printer according to the embodiment of the present disclosure.

As shown in FIG. 5 and FIG. 6, the axial hole part 91 of the dial gear 67 is inserted to the second shaft 29*h* of the right side plate 29*d* with the gear part 93 facing the inner face of the outer side plate 32. As shown in FIG. 6, the dial gear 67 is biased along the axial direction of the second shaft 29*f* toward the protrusion 29*i* by a spring 111. Thereby, one of the recesses 105 (refer to FIG. 9A and FIG. 9B) of the rib 103 is engaged with the protrusion 29*i* of the right side plate 29*d* to restrict the dial gear 67 from being rotated. The gear teeth 97 of the gear part 93 is meshed with the gear teeth 81 of the gear part 75 of the adjustment plate 65, and the adjustment plate 65 is engaged with the dial gear 67. The rack teeth 99 of the rack part 95 is exposed to the side opening 61 of the outer side plate 32.

When the dial gear 67 is rotated in one direction, the adjustment plate 65 is rotated in a counter direction to the rotation direction of the dial gear 67. Then, the outer circumferential edge of the adjustment plate 65 exposed through the lower end portion of the groove 53 is changed. That is, by rotating the dial gear 67, one of the first arc-shaped edge 77, the second arc-shaped edge 78 and the third arc-shaped edge 79 is exposed through the lower end portion of the groove 53.

Additionally, the dial gear 67 is prevented from being rotated with respect to the right side plate 29*d* at a position where one of the first arc-shaped edge 77, the second arc-shaped edge 78 and the third arc-shaped edge 79 is exposed through the lower end portion of the groove 53. In detail, when the dial gear 67 is rotated, one inclined side face of the recess 105 engaged with the protrusion 29*i* comes into contact with the protrusion 29*i*, the inclined side face is guided in a direction away from the protrusion 29*i* against the biasing force of the spring 111, and then the rib 103 runs on the protrusion 29*i*. When the dial gear 67 is further rotated, the dial gear 67 is biased by the spring 111 in a direction close to the protrusion 29*i*, and then the adjacent recess 105 is engaged with the protrusion 29*i*. At this time, a click feeling is offered on the dial gear 67.

When the drum unit 23 is attached to the above described attachment section S, as shown in FIG. 2, the left flange member 37 of the photosensitive drum 31 is inserted in the flange receiving groove 51 of the left side plate 29*c*. Additionally, the pressing lever 41 is engaged with the left sideplate 29*c*, and the spring 43 biases the left flange member 37 downward with respect to the pressing lever 41 so that the left flange member 37 is positioned. And, as shown in FIG. 4, the right end portion of the rotation shaft 39 of the photosensitive drum 31 is inserted in the vertical groove 57 of the outer side plate 32. The pressing lever 41 is engaged with the outer side plate 32, and the spring 43 biases the right end portion of the photosensitive drum 31 downward with respect to the pressing lever 41 so that the right end portion of the rotation shaft 39 is positioned.

Figure 10:
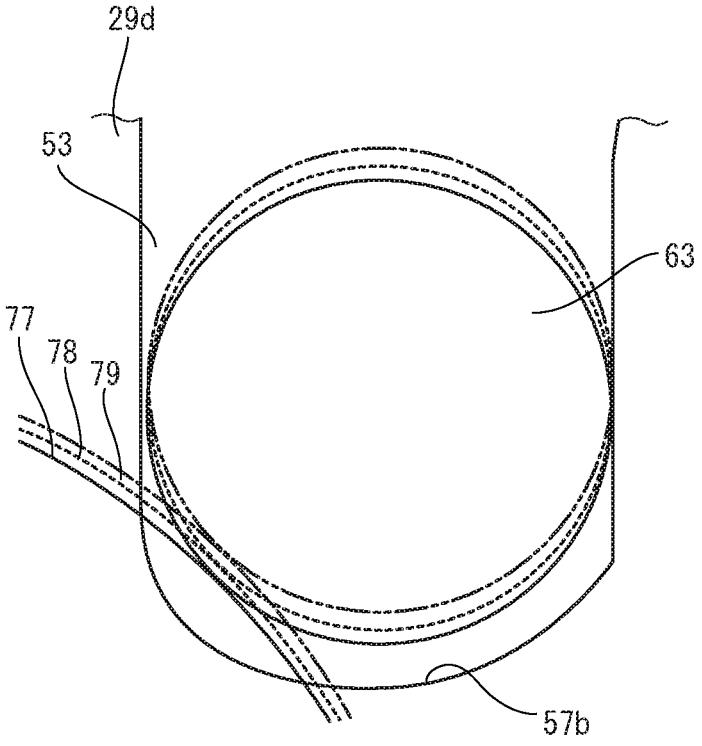
FIG. 10 is a front view showing a groove and a movable shaft, in the color printer according to the embodiment of the present disclosure.

In the image forming unit 17 having the above described configuration, a skew adjustment way of a first embodiment will be described with reference to FIG. 4, FIG. 5, and FIG. 10 to FIG. 13. FIG. 10 is a front view showing the movable shaft and the groove, FIG. 11 is a view explaining the tuning of the outer side plate, and FIG. 12 is a view explaining a displacement of a writing position of the laser light.

As shown in FIG. 10, the movable shaft 63 of the outer side plate 32 comes into contact with the outer circumferential edge (the first arc-shaped edge 77, for example) of the adjustment part 73 of the adjustment plate 65 in the groove 53 of the right side plate 29*d*. A finger is inserted through the side opening 61 of the outer sideplate 32, catches the rack teeth 99 of the rack part 95 of the dial gear 67 and then rotates the dial gear 67 in the clockwise direction in FIG. 5 until the click feeling is felt. Then, the adjustment plate 65 is rotated in the counterclockwise direction in FIG. 5, and then, the second arc-shaped edge 78 and the third arc-shaped edge 79 are exposed through the lower end portion of the groove 53 in the order. Because the first to third arc-shaped edges 77 to 79 have radiuses which become larger in a stepwise manner in the order, the movable shaft 63 is pushed up along the groove 53 by the second and third arc-shaped edges 78 and 79.

Figure 11:
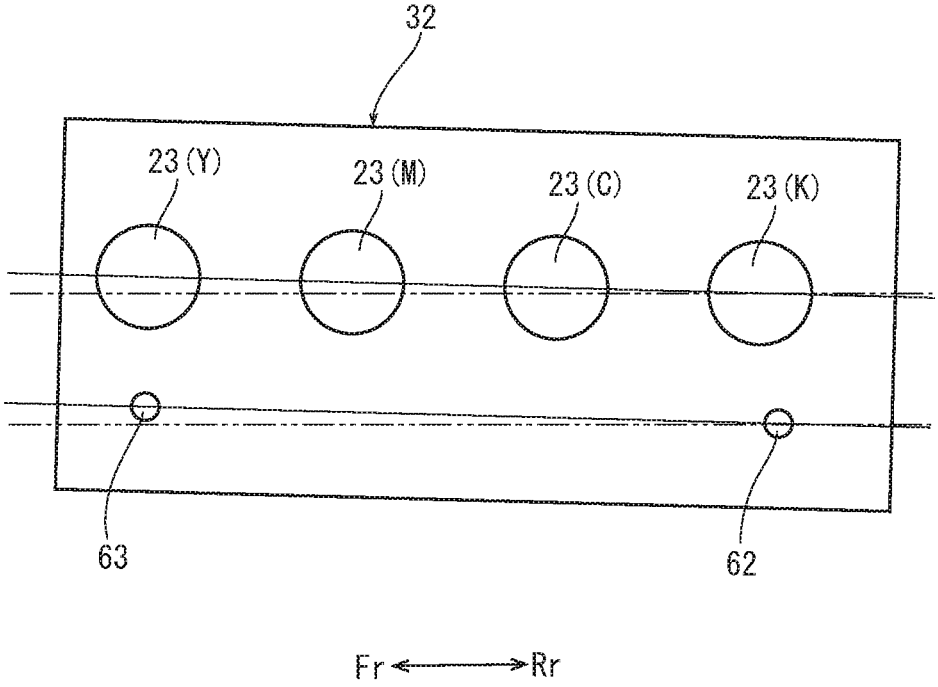
FIG. 11 is a front view explaining a turning of the outer side plate, in the color printer according to the embodiment of the present disclosure.

When the movable shaft 63 is pushed up, as shown in FIG. 11, the outer side plate 32 is turned upward in the vertical plane around the supporting shaft 62. At the same time, as shown in FIG. 12, each photosensitive drum 31 is inclined upward to the right side.

Figure 12:
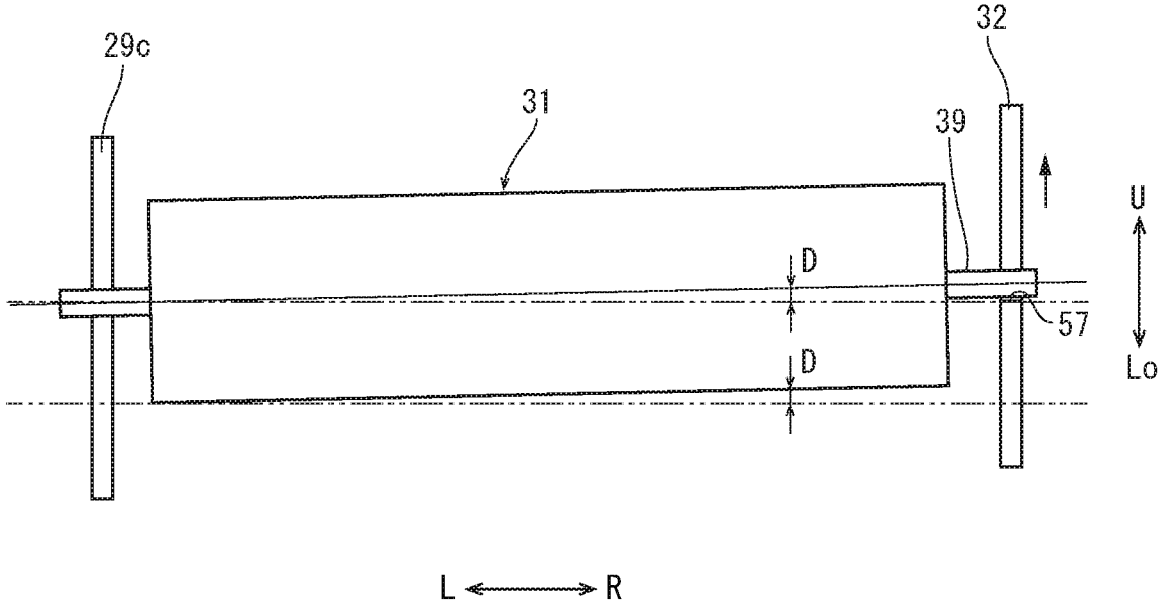
FIG. 12 is a side view explaining an inclined photosensitive drum, in the color printer according to the embodiment of the present disclosure.
Figure 13:
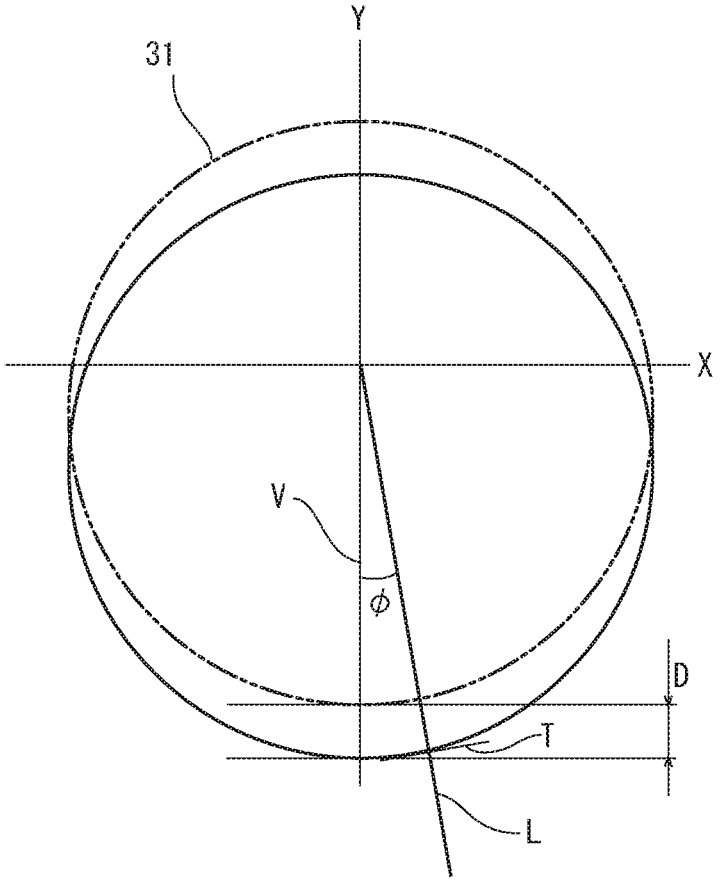
FIG. 13 is a view schematically explaining a writing position displacement of laser light, in the color printer according to the embodiment of the present disclosure.
Figure 13:
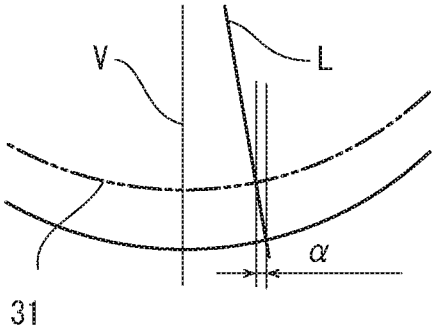

When the photosensitive drum 31 is inclined upward to the right side as shown in FIG. 12, a vertical shift distance D of the right end portion of the rotation shaft 39 becomes larger gradually from the left side to the right side along the axial direction of the rotation shaft 39. As shown in FIG. 13, an angle of incidence of the laser light L with respect to a tangential line T on the surface of the photosensitive drum 31 is zero, and an angle $\varphi$ of the laser light L with respect to the vertical line V passing through the axial center of the photosensitive drum 31 is about 10 degrees. When the right end portion of the rotation shaft 39 is shifted along the vertical direction, as shown in FIG. 13, the writing position is displaced in the circumferential direction of the photosensitive drum 31. The displacement distance $\alpha$ becomes large as the vertical shift distance D becomes large. As shown in FIG. 12, because the vertical shift distance D becomes large from the left side to the right side along the axial direction of the rotation shaft 39, the displacement distance $\alpha$ increases from the left side to the right side. As a result, the writing position is displaced obliquely with respect to the axial direction of the photosensitive drum 31 so that the skew adjustment becomes possible.

Additionally, as shown in FIG. 11, when the outer side plate 32 is turned upward in the vertical plane around the supporting shaft 62, the shift distance of the right end portion of the rotation shaft 39 of the photosensitive drum 31 increases in proportion to a distance from the supporting shaft 62. In detail, the shift distance of the right end portion of the rotation shaft 39 of the photosensitive drum 31 corresponding to black, which is closest to the supporting shaft 63, is smallest, and the shift distance of the right end portion of the rotation shaft 39 of the photosensitive drum 31 corresponding to yellow, which is farthest from the supporting shaft 62, is largest.

Figure 14:
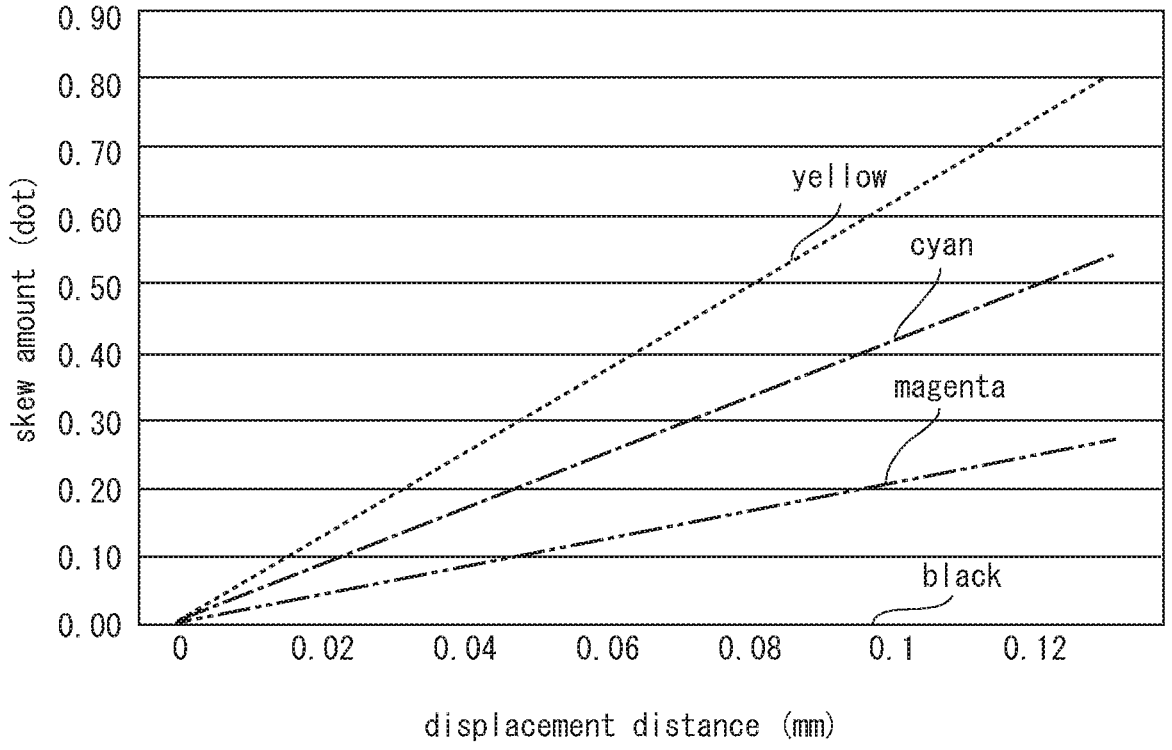
FIG. 14 is a graph showing a relationship between an amount of the writing position displacement and an amount of the skew.

The skew amount of each photosensitive drum 31 will be described with reference to FIG. 14. FIG. 14 is a graph showing a relationship between the shift distance of the photosensitive drum of each color with respect to the photosensitive drum of the reference color (black) and the skew amount. The horizontal axis of the graph shows the shift distance and the vertical axis of the graph shows the skew amount. In FIG. 14, a solid line indicates black, a one-dotted chain line indicates magenta, a two-dotted chain line indicate the cyan and a broken line indicates yellow.

Conventionally, the photosensitive drum 31 (the drum unit 23) corresponding to black, which is the reference color, is positioned with high precision, and the positioning precision becomes low as the distance from the drum unit 23 corresponding to black becomes long. Accordingly, the skew amount increases in proportion to the distance from the photosensitive drum 31 corresponding to black. That is, as shown in the graph of FIG. 14, the photosensitive drum 31 corresponding to yellow, which is arranged farthest from the photosensitive drum 31 corresponding to black, has the largest skew amount.

As described above, according to the present disclosure, the right end portions of the rotation shafts 39 of all the photosensitive drums 31 are supported by the outer side plate 32 so that color shift of the toner image of each color is reduced. Additionally, by turning the outer side plate 32 in the vertical plane by the main adjustment mechanism 30, it becomes possible to correct the skew for all the photosensitive drums 31. That is, one adjustment work allows the skew adjustment for all the photosensitive drums 31 and it becomes possible to carry out the skew adjustment work effectively using a simple structure.

The shift distance of the right end portion of the rotation shaft 39 of the photosensitive drum 31 increases in proportion to the distance from the supporting shaft 62. Because the supporting shaft 62 is arranged near the attachment section S to which the drum unit 23 corresponding to the reference color (black) is attached, the skew amount increases in proportion to the distance from the drum unit 23 corresponding to black owing to positioning precision. As described, an increasing tendency for the skew amount is the same as an increasing tendency for the shift distance of the right end portion of the rotation shaft 39 of the photosensitive drum 31 so that the displacement distance of the writing position can be adjusted according to the skew amount.

Additionally, because the right end portions of the rotation shafts 39 of all the photosensitive drums 31 are supported by the outer side plate 32, if the skew is adjusted for any one of the photosensitive drums 31, the skew can be automatically adjusted for the other photosensitive drums 31. In this case, because the photosensitive drum 31 corresponding to yellow, which has a largest adjustment width, in other words, a longest shift distance of the rotation shaft 39, is adjusted for its skew, the skew adjustment work can be easily carried out.

In the present embodiment, the attachment section S of the drum unit 23 corresponding to the reference color (black) is arranged at the end portion (the rear end portion) in the parallel direction (the front-and-rear direction). If the reference color is a color other than black, the shaft 62 is preferably provided near the attachment section S of the drum unit 23 corresponding to the reference color.

The mechanism to shift the movable shaft 63 of the outer side plate 32 is not limited to the mechanism of the present embodiment.

Figure 15:
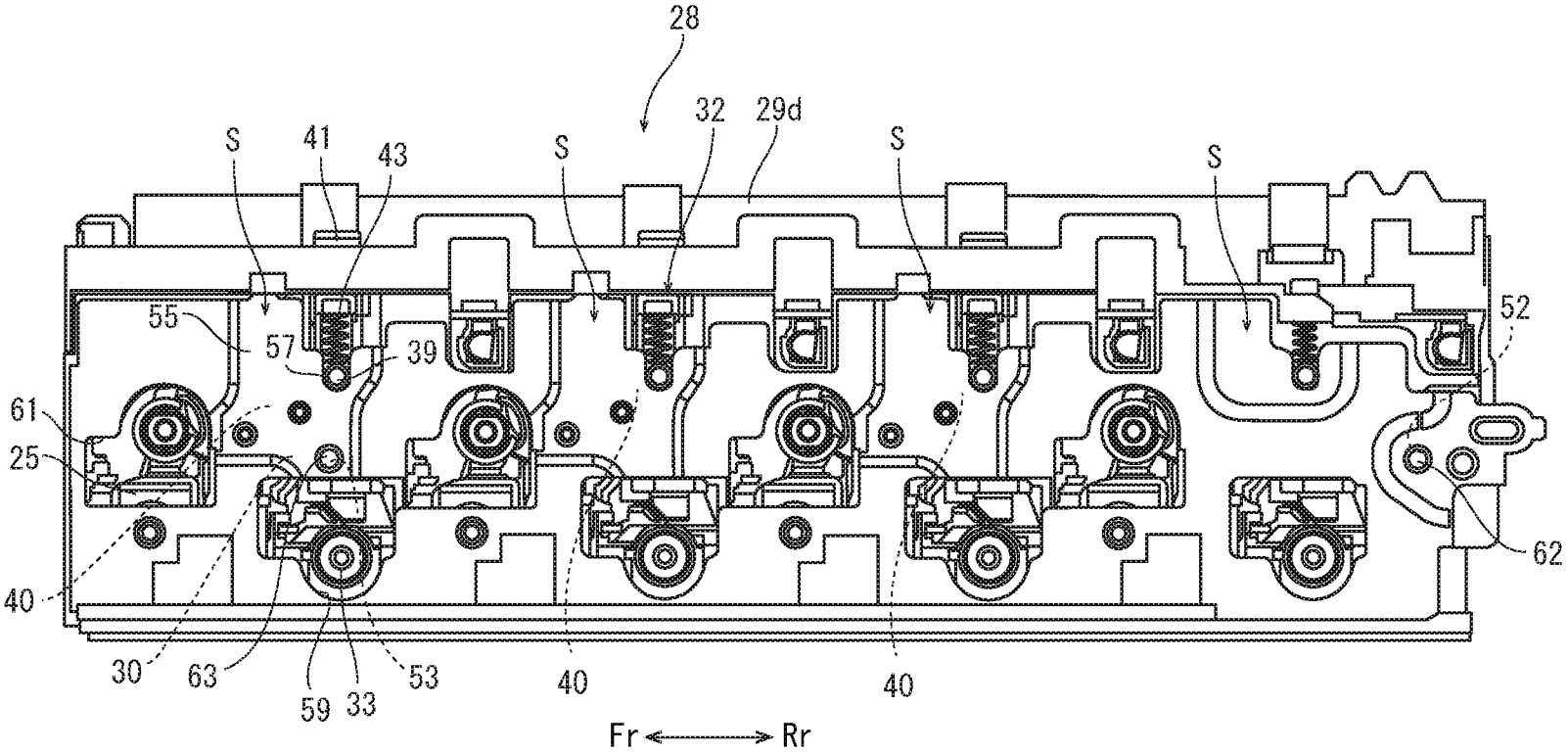
FIG. 15 is a front view showing the outer side plate and the right side plate in the skew adjustment way of a second embodiment, in the color printer according to the embodiment of the present disclosure.

Next, a skew adjustment way of a second embodiment will be described with reference to FIG. 15. FIG. 15 is a front view showing the right side plate and the outer plate.

In the second embodiment, each attachment section S corresponding to colors (cyan, magenta and yellow) other than black is provided with a sub adjustment mechanism 40. The sub adjustment mechanism 40 includes the adjustment plate 65 as a sub adjustment plate and the dial gear 67. The adjustment plate 65 and the dial gear 67 have the same structures as those of the main adjustment mechanism 30. That is, the adjustment plate 65 and the dial gear 67 are supported in a rotatable manner on an inner face of the hollow portion 55 of each attachment section S of the outer side plate 32. A part of the outer circumferential edge (for example, the first arc-shaped edge 77) of the attachment part 73 of the attachment plate is exposed through a lower end portion of the vertical groove 57 obliquely from the front lower side. The right end portion of the rotation shaft 39 of the photosensitive drum 31 is pressed on the rear side edge of the vertical groove 57 by the first arc-shaped edge 77 of the adjustment part 73. When the dial gear 67 is operated to rotate the adjustment plate 65, the right end portion of the rotation shaft 39 is shifted vertically along the rear side edge of the vertical groove 57.

In the second embodiment, not only by turning the outer side plate 32 to which the right end portions of the rotation shafts 39 of all the photosensitive drums 31 in the vertical plane, but also by shifting the right end portions of the rotation shafts 39 of the photosensitive drums 31 corresponding to cyan, magenta and yellow, individually, the writing positions are adjusted. The shift distance of the right end portion of the rotation shaft 39 and the displacement distance of the writing position are described above with reference to FIG. 12 and FIG. 13. When the side edge to which the right end portion of the rotation shaft 39 is pressed is formed along the vertical direction, an oblique direction or the horizontal direction, it becomes possible to select the adjustment sensitivity.

The rotation shaft 39 of the photosensitive drum 31 corresponding to black is positioned with high precision as described above. Additionally, when the outer side plate 32 is turned so as to adjust the skew of the photosensitive drum 31 corresponding to black, the skew of the photosensitive drum 31 corresponding to each of another colors is automatically adjusted. However, even if the outer side plate 32 is turned so as to adjust the skew of the photosensitive drum 31 corresponding to black, when the skew of the photosensitive drum 31 corresponding to each of the other colors is not be adjusted suitably, by performing fine adjustment using the sub adjustment mechanism 40, it becomes possible to adjust the skew of the photosensitive drum 31 corresponding to each of the other colors surely.

The sub adjustment mechanism 40 may be provided in the attachment section S of the drum unit 23 corresponding to black. In this case, it becomes possible to surely adjust the skew of the photosensitive drum 31 corresponding to the reference color (black).

The sub adjustment mechanism 40 may be provided in the attachment section S of the drum unit 23 corresponding to all colors. In this case, it becomes possible to surely adjust the skew of the photosensitive drum 31 corresponding to all colors.

In the first and second embodiments, the outer side plate 32 is supported by the right side plate 29*d* in a turnable manner around the supporting shaft 62. On the other hand, in the other embodiments, the outer side plate 32 may be supported in a movable manner in the upper-and-lower direction or the right-and-left direction in the vertical plane. Alternatively, the outer side plate 32 may support the left end portion of the rotation shaft 39.

While the above description has been described with reference to the particular illustrative embodiments of the image forming apparatus according to the present disclosure, a technical range of the disclosure is not to be restricted by the description and illustration of the embodiment.

The invention claimed is:

1. An image forming apparatus comprising:

a photosensitive drum provided for each of a plurality of colors forming a color image;

an exposure device configured to emit a laser light on each of the photosensitive drums to form an electrostatic latent image;

a supporting member configured to support end portions of rotation shafts of all the photosensitive drums; and a main adjustment member configured to shift the supporting member in a vertical plane to adjust a skew of the laser light.

2. The image forming apparatus according to claim 1, wherein the photosensitive drums are arranged in parallel along a parallel direction perpendicular to an axial direction of the rotation shaft of the photosensitive drum, the supporting member has a supporting shaft provided at one end in the parallel direction and a movable shaft provided at the other end in the parallel direction, and the main adjustment member moves the movable shaft to turn the supporting member in the vertical plane around the supporting shaft.

3. The image forming apparatus according to claim 2, wherein the laser light is irradiated on the photosensitive drum at a predetermined angle with respect to a vertical line passing through a center of the photosensitive drum.

4. The image forming apparatus according to claim 2, wherein the supporting shaft is arranged closest to the photosensitive drum corresponding to a reference color among the plurality of colors.

5. The image forming apparatus according to claim 4, wherein the plurality of colors includes black, magenta, cyan and yellow, the photosensitive drum corresponding to black is arranged closest to the supporting shaft, and the photosensitive drum corresponding to yellow is arranged farthest from the supporting shaft.

6. The image forming apparatus according to claim 1, wherein the supporting member has a groove into which the end portion of the rotation shaft of the photosensitive drum is inserted, and a sub adjustment member is provided so as to shift the end portion of the rotation shaft in the groove and to adjust the skew of the laser light.

7. The image forming apparatus according to claim 6, wherein the sub adjustment member is rotatable and has an arc-shaped circumferential edge configured to come into contact with the end portion of the rotation shaft inserted in the groove, to press the end portion of the rotation shaft on an edge of the groove and to support the end portion of the rotation shaft with the edge of the groove, wherein the circumferential edge is configured such that a radius is varied along a circumferential direction, and when the sub adjustment member is rotated, a contact position of the circumferential edge with the end portion of the rotation shaft is varied and then the end portion of the rotation shaft is shifted along the edge of the groove.

8. The image forming apparatus according to claim 6, wherein the sub adjustment member shifts the end portion of the rotation shaft of the photosensitive drum corresponding to each of the colors other than the reference color.

9. The image forming apparatus according to claim 6, wherein the sub adjustment member shifts the end portion of the rotation shaft of the photosensitive drum corresponding to the reference color.

10. The image forming apparatus according to claim 6, wherein the sub adjustment member shifts the end portion of the rotation shaft of each of all the photosensitive drums.

* * * * *